US006577302B2

(12) United States Patent
Hunter et al.

(10) Patent No.: US 6,577,302 B2
(45) Date of Patent: Jun. 10, 2003

(54) DISPLAY DEVICE HAVING CURRENT-ADDRESSED PIXELS

(75) Inventors: Iain M. Hunter, Brighton (GB); Neil C. Bird, Horley (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 180 days.

(21) Appl. No.: 09/819,284

(22) Filed: Mar. 28, 2001

(65) Prior Publication Data

US 2001/0026251 A1 Oct. 4, 2001

(30) Foreign Application Priority Data

Mar. 31, 2000 (GB) ..... 0008019

(51) Int. Cl.[7] ..... G09G 5/00
(52) U.S. Cl. ..... 345/204; 345/205; 345/206
(58) Field of Search ..... 345/204, 205, 345/206

(56) References Cited

U.S. PATENT DOCUMENTS 5,025,248 A * 6/1991 Bergeron ..... 340/596
5,670,792 A 9/1997 Utsugi et al. ..... 257/59
2001/0019327 A1 * 9/2001 Kim et al. ..... 345/204

FOREIGN PATENT DOCUMENTS

EP 0653741 A1 5/1995 ..... G09G/3/30
EP 0717446 A2 6/1996 ..... H01L/27/15
WO WO9636959 11/1996 ..... G09G/3/30

* cited by examiner

*Primary Examiner*—Bipin Shalwala
*Assistant Examiner*—Vincent E. Kovalick

(57) ABSTRACT

A display device has current-addressed pixels, with the currents being supplied by driver circuitry which comprises a transistor (10) for applying a charging voltage to a switched capacitor arrangement (Ci, S1, S2) arranged to selectively charge and discharge the capacitor (Ci) at a predetermined rate to a charging voltage. A transistor control voltage (Vref) is applied to a control terminal of the transistor which is adjusted depending on the transistor threshold voltage to ensure that the capacitor (Ci) is charged to the charging voltage irrespectively of the value of the threshold voltage. This enables an accurately controllable current to be provided which is used to drive the current-addressed pixels.

10 Claims, 8 Drawing Sheets

DISPLAY DEVICE HAVING CURRENT-ADDRESSED PIXELS

The invention relates to a current source used as part of the control circuitry for display devices, and particularly display devices having current-addressed pixels. Such display devices may comprise an array of electroluminescent display pixels arranged in rows and columns.

Matrix display devices employing electroluminescent, light-emitting, display elements are well known. The display elements may comprise organic thin film electroluminescent elements, for example using polymer materials, or else light emitting diodes (LEDs) using traditional III–V semiconductor compounds. Recent developments in organic electroluminescent materials, particularly polymer materials, have demonstrated their ability to be used practically for video display devices. These materials typically comprise one or more layers of a semiconducting conjugated polymer sandwiched between a pair of electrodes, one of which is transparent and the other of which is of a material suitable for injecting holes or electrons into the polymer layer.

The polymer material can be fabricated using a CVD process, or simply by a spin coating technique using a solution of a soluble conjugated polymer. Organic electroluminescent materials exhibit diode-like I–V properties, so that they are capable of providing both a display function and a switching function, and can therefore be used in passive type displays. Alternatively, these materials may be used for active matrix display devices, with each pixel comprising a display element and a switching device for controlling the current through the display element. Examples of an active matrix electroluminescent display are described in EP-A-0653741 and U.S. Pat. No. 5,670,792, the contents of which are incorporated herein by way of reference material.

A problem with display devices of this type arises from the fact that they have current-addressed display elements. Conventional supply circuitry for supplying a controllable current to the display elements can suffer the drawback that the current varies as a function of the electrical characteristics of the switching transistors used in the supply circuitry. For example, a current controlling transistor may be provided as part of the pixel configuration, with the gate voltage supplied to the transistor determining the current through the display element. Different transistor characteristics give rise to different relationships between the gate voltage and the source-drain current. Such an arrangement is described in EP-A-0653741.

The current controlling circuitry may either comprise part of the pixel configuration, as described above, so that a pixel voltage is supplied to the pixels, or else the current controlling circuitry may comprise separate circuitry provided at the periphery of the display area, so that a pixel current is supplied to the pixels. In either case, if the current controlling circuitry is integrated onto the same substrate as the display pixels, it typically comprises thin film switching elements such as thin film transistors. The uniformity across the substrate of the electrical characteristics of the switching elements may be poor, which gives rise to unpredictable variations in the pixel currents and therefore the pixel outputs.

According to the invention, there is provided a display device comprising:

an array of pixels arranged in rows and columns, each pixel comprising a current-addressed display element;

driver circuitry for generating current signals corresponding to desired outputs from the display elements, the driver circuitry comprising a transistor switching device for applying a charging voltage to a switched capacitor arrangement, which comprises a capacitor and a switch arrangement enabling the capacitor to be selectively charged and discharged at a predetermined rate to the charging voltage, wherein a transistor control voltage is applied to a control terminal of the transistor switching device so as to provide the charging voltage to the switched capacitor arrangement, and wherein the transistor control voltage is adjusted depending on the transistor threshold voltage thereby to ensure that the capacitor is charged to the charging voltage irrespectively of the value of the threshold voltage.

The driver circuitry used in the display device of the invention enables an accurately controllable current to be provided which is used to drive the current-addressed pixels. The circuit is implemented using capacitors and transistors and can therefore be integrated onto the display device active plate, and variations across the plate giving rise to transistor threshold variations are compensated.

A sampling circuit may be provided for adjusting the transistor control voltage, the sampling circuit comprising a switch arrangement and a threshold capacitor, the sampling circuit being operable in a first mode to charge the threshold capacitor to the transistor threshold voltage and in a second mode to add the transistor threshold voltage stored on the threshold capacitor to a transistor control voltage.

The threshold voltage of the transistor is thus measured and compensated by storing charge on a threshold capacitor.

The switched capacitor arrangement may comprise a first pair of switches and first associated capacitor, and a second pair of switches and second associated capacitor, wherein the switches are operated to provide charging of one capacitor simultaneously with discharging of the other capacitor. This enables a continuous charging current to be drawn by the switched capacitor arrangement, which reduces the current ripple of the current supply.

The switched capacitor arrangement may also comprise a column capacitor which is charged during an initial operation period of the driver circuitry. This enables compensation for the column capacitance of a column of pixels at the start of the current generation cycle, so that the circuit stabilizes more rapidly.

Instead of sampling the threshold voltage, the adjusted transistor control voltage may be provided by the output of a differential amplifier, with one of the amplifier inputs being supplied with the non-adjusted transistor control voltage and the other of the amplifier inputs being supplied to the switched capacitor arrangement as the charging voltage.

Preferably each pixel comprises an electroluminescent display element, and each pixel may comprise first and second switching means, operable in a first mode in which the input current is supplied by the first switching means to the second switching means, a control level being stored for the second switching means corresponding to the input current, and in a second mode in which the stored control level is applied to the second switching means so as to drive a current corresponding to the input current through the display element.

Embodiments of display devices in accordance with the invention will now be described, by way of example, with reference to the accompanying drawings, in which.

Figure 1:
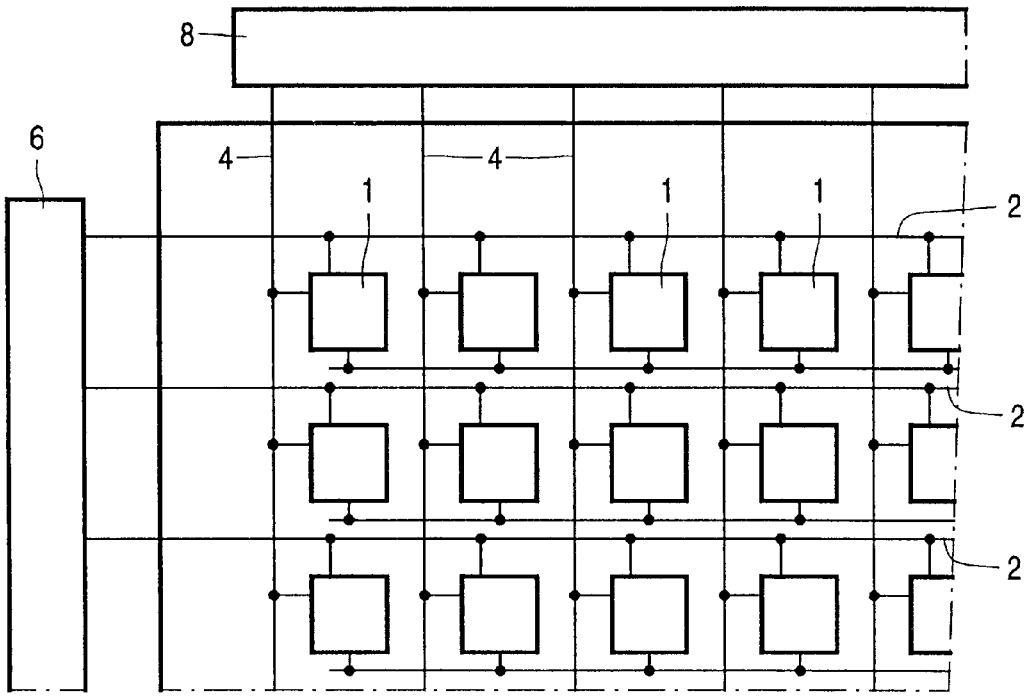
FIG. 1 is a simplified schematic diagram of part an embodiment of display device according to the invention.

Referring to FIG. 1, an active matrix addressed electroluminescent display device comprises a panel having a row and column matrix array of regularly-spaced pixels, denoted by the blocks 1 and comprising electroluminescent display elements together with associated switching means, located at the intersections between crossing sets of row (selection) and column (data) address conductors 2 and 4. Only a few pixels are shown in the Figure for simplicity. In practice there may be several hundred rows and columns of pixels. The pixels 1 are addressed via the sets of row and column address conductors by a peripheral drive circuit comprising a row, scanning,driver circuit 6 and a column, data, driver circuit 8 connected to the ends of the respective sets of conductors. The invention relates specifically to a current supply circuit suitable for use in the column driver circuit 8. However, the operation of a display device having current-addressed pixels will first be described in more detail below.

Figure 2:
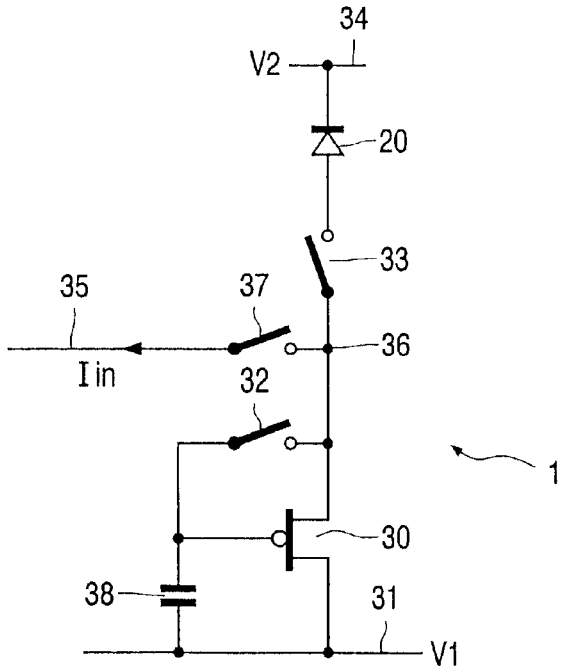
FIG. 2 shows in simple form the equivalent circuit of a typical pixel circuit comprising a display element and its associated control circuitry in the display device of FIG. 1.
Figure 3:
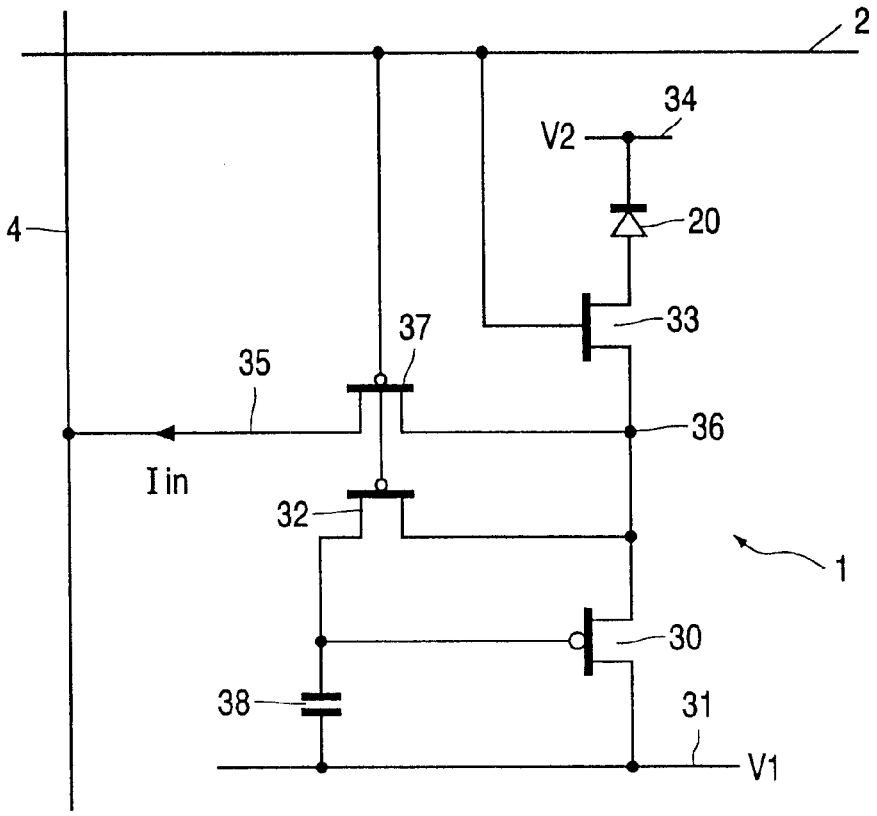
FIG. 3 illustrates a practical realisation of the pixel circuit of FIG. 2.

FIG. 2 shows in simplified schematic form the circuit of a typical pixel block 1 in the array and is intended to illustrate the basic manner of its operation. A practical implementation of the pixel circuit of FIG. 2 is illustrated in FIG. 3.

The electroluminescent display element, referenced at 20, comprises an organic light emitting diode, represented here as a diode element (LED) and comprising a pair of electrodes between which one or more active layers of organic electroluminescent material is sandwiched. The display elements of the array are carried together with the associated active matrix circuitry on one side of an insulating support. Either the cathodes or the anodes of the display elements are formed of transparent conductive material. The support is of transparent material such as glass and the electrodes of the display elements 20 closest to the substrate may consist of a transparent conductive material such as ITO so that light generated by the electroluminescent layer is transmitted through these electrodes and the support so as to be visible to a viewer at the other side of the support. Typically, the thickness of the organic electroluminescent material layer is between 100 nm and 200 nm. Typical examples of suitable organic electroluminescent materials which can be used for the elements 20 are described in EP-A-0 717446 to which reference is invited for further information and whose disclosure in this respect is incorporated herein. Electroluminescent materials such as conjugated polymer materials described in W096/36959 can also be used.

Each display element 20 has an associated switch means which is connected to the row and column conductors 2 and 4 adjacent the display element and which is arranged to operate the display element in accordance with an applied analogue drive (data) signal level that determines the element's drive current, and hence light output. The display data signals are provided by the column driver circuit 8 which acts as a current source. This invention is directed specifically at the column driver circuit, described below.

A suitably processed video signal is supplied to this circuit 8 which samples the video signal and applies a current constituting a data signal related to the video information to each of the column conductors for the appropriate row addressed by the row driver circuit 6.

Referring to FIG. 2, the switch means comprises a drive transistor 30, more particularly a p-channel FET, whose source is connected to a supply line 31 and whose drain is connected, via a switch 33, to the anode of the display element 20. The cathode of the display element is connected to a second supply line 34, which in effect is constituted by a continuous electrode layer held at a fixed reference potential.

The gate of the transistor 30 is connected to the supply line 31, and hence the source electrode, via a storage capacitance 38 which may be a separately formed capacitor or the intrinsic gate-source capacitance of the transistor. The gate of the transistor 30 is also connected via a switch 32 to its drain terminal.

The transistor circuit operates in the manner of a single transistor current mirror with the same transistor performing both current sampling and current output functions and with the display element 20 acting as the load. An input to this current mirror circuit is provided by driving a current out of an input line 35 which connects to a node 36 between the switches 32 and 33, constituting an input terminal, via a further switch 37 which controls the drawing of current from the node.

Operation of the circuit takes place in two phases. In a first, sampling, phase, corresponding in time to an addressing period, an input current signal for determining a required output from the display element is drawn from the circuit and a consequential gate—source voltage on the transistor 30 is sampled and stored in the capacitance 38. In a subsequent, output, phase the transistor 30 operates to drive current through the display element 20 according to the level of the stored voltage so as to produce the required output from the display element, as determined by the input signal, which output is maintained for example until the display element is next addressed in a subsequent, new, sampling phase. During both phases it is assumed that the supply lines 31 and 34 are at appropriate, pre-set, potential levels, V1 and V2. The supply line 31 will normally be at ground potential (V1) and the supply line 34 will be at a negative potential (V2).

During the sampling phase, the switches 32 and 37 are closed, which diode—connects the transistor 30, and the switch 33 is open, which isolates the display element load. An input signal, corresponding to the required display element current and denoted here as Iin, is drawn through the transistor 30 from an external source, e.g. the column driver circuit 8 in FIG. 1, via the input line 35, the closed switch 37 and the input terminal 36. Because the transistor 30 is diode—connected by virtue of the closed switch 32, the voltage across the capacitance 38 at the steady state condition will be the gate—source voltage that is required to drive a current lin through the channel of the transistor 30. Having allowed sufficient time for this current to stabilise, the sampling phase is terminated upon the opening of the switches 32 and 37 isolating the input terminal 36, from the input line 35 and isolating the capacitance 38 so that the gate—source voltage, determined in accordance with the input signal lin, is stored in the capacitance 38. The output phase then begins upon the closing of the switch 33 thus connecting the display element anode to the drain of the transistor 30. The transistor 30 then operates as a current source and a current approximately equal to lin is driven through the display element 20.

The drive current for the display element may differ very slightly from the input current lin because of capacitive coupling due to charge injection effects when switch 32 turns off causing a change in the voltage on capacitance 38 and also because the transistor 30 may not act as a perfect current source as in practice it is likely to have a finite output resistance. Because, however, the same transistor is used to sample lin during the sampling phase and to generate the current during the output phase, the display element current is not dependent on the threshold voltage or the mobility of the transistor 30.

FIG. 3 shows a practical embodiment of the pixel circuit of FIG. 2 used in the display device of FIG. 1. In this, the switches 32, 33 and 37 are each constituted by transistors and these switching transistors, together with the drive transistor 30, are all formed as thin film field effect transistors, TFTs. The input line 35, and the corresponding input lines of all pixel circuits in the same column, are connected to a column address conductor 4 and through this to the column driver circuit 8. The gates of the transistors 32, 33 and 37, and likewise the gates of the corresponding transistors in pixel circuits in the same row, are all connected to the same row address conductor 2. The transistors 32 and 37 comprise p-channel devices and are turned on (closed) by means of a selection (scan) signal in the form of a voltage pulse applied to the row address conductor 12 by the row driver circuit 16. The transistor 33 is of opposite conductivity type, comprising a n-channel device, and operates in complementary fashion to the transistors 32 and 37 so that it turns off (opens) when the transistors 32 and 37 are closed in response to a selection signal on the conductor 2, and vice versa.

The supply line 31 extends as an electrode parallel to the row conductor 2 and is shared by all pixel circuits in the same row. The supply lines 31 of all rows can be connected together at their ends. The supply lines may instead extend in the column direction with each line then being shared by the display elements in a respective column. Alternatively, supply lines may be provided extending in both the row and column directions and interconnected to form a grid structure.

The array is driven a row at a time in turn with a selection signal being applied to each row conductor 2 in sequence. The duration of the selection signal determines a row address period, corresponding to the period of the aforementioned sampling phase. In synchronisation with the selection signals, appropriate input current drive signals, constituting data signals, are applied to the column conductors 4 by the column driver circuit 8 as required for a row at a time addressing so as to set all the display elements in a selected row to their required drive level simultaneously in a row address period with a respective input signals determining the required display outputs from the display elements. Following addressing of a row in this way, the next row of display elements is addressed in like manner. After all rows of display elements have been addressed in a field period the address sequence is repeated in subsequent field periods with the drive current for a given display element, and hence the output, being set in the respective row address period and maintained for a field period until the row of display elements concerned is next addressed.

The invention relates specifically to the circuitry for supplying the current drive signals to the columns of pixels. In particular, the invention relates to a switched capacitor current source which can be implemented using poly-silicon TFT devices, and can therefore be integrated onto the active plate of a display device having current driven pixels.

The principle of the current source is the continual charging and; discharging of a known capacitor to a known voltage. Of course, the charge on a capacitor is given by Q=C.V. If a fully discharged capacitor is cyclically charged to a voltage Vc, using a fixed amount of charge, then discharged again at a rate of F times per second then:

Irms=C.Vc.F, where Irms is the root mean squared charging current.

Figure 14:
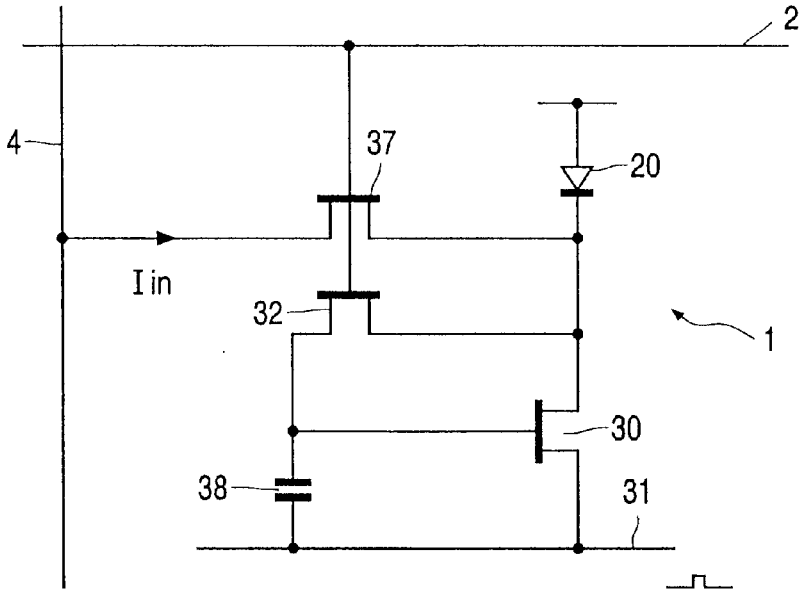
FIG. 14 shows an alternative pixel circuit.

FIG. 14 shows a circuit for current control using a switched capacitor arrangement. In this circuit, S1 is a discharging switch and S2 is a charging switch. These two switches are operated in anti-phase with one another. The capacitor Ci, referred to hereinafter as a charging capacitor, will be charged to a voltage V when S2 is closed and S1 is open, ignoring the voltage drop across S2. When S2 is open and S1 is closed the capacitor discharges through S1.

The columns of an active matrix display can be driven by the capacitor charging currents by arranging the columns to act as the current supply. For example, during the current sampling phase of the pixel circuit of FIG. 2, the current drawn by the switched capacitor arrangement can be supplied by the line 35. In other pixel configurations, the interconnection of the pixel columns to the current supply circuitry will be different. As a capacitance of value C can be accurately constructed on the active matrix plate, and the frequency F can be accurately controlled, for example using a subdivision of the pixel clock, a precision current source can thereby be created whose value is dependent on these two variables and the charging voltage.

Figure 4:
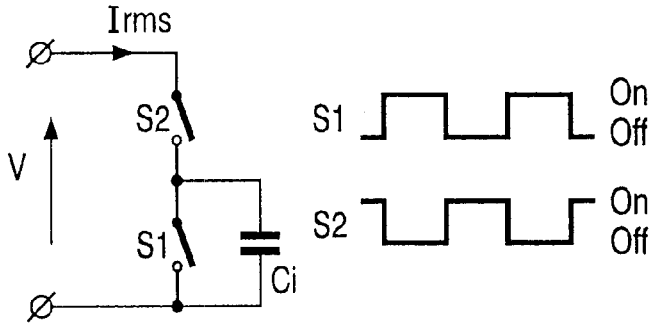
FIG. 4 shows the operating principle of a switched capacitor current source.
Figure 5:
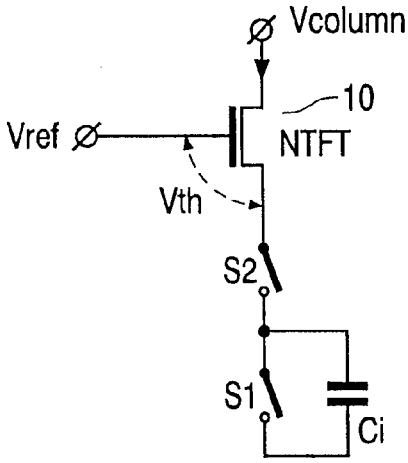
FIG. 5 shows how the switched capacitor source may be implemented.

For practical implementation of the circuit for video signals, the main difficulty is to control accurately the voltage to which the capacitor is charged. The frequency F and capacitance value Ci are more easily fixed. FIG. 5 shows a practical implementation of the circuit of FIG. 4, in which an n-channel TFT is used to control the charging voltage.

A reference voltage greater than the TFT threshold voltage, $V_{th}$, is applied to the gate of the TFT. When S2 is closed and S1 is open the charging capacitor Ci (the capacitor to which the charging current is supplied) will charge towards the voltage Vcolumn through the TFT. However when Ci has charged to Vref−Vth, i.e. the reference voltage on the gate less the gate-source threshold voltage, the TFT will stop conducting and the capacitor will stop charging. After a fixed time period, S2 will open and S1 will close, discharging Ci through S1. The cycle will begin again and each time an amount of charge equal to C.(Vref−Vth) is sourced through the column.

Because the TFT threshold voltage has an influence on the current source output value, and the TFT uniformity throughout a display is not guaranteed, a method of offsetting the gate voltage by the TFT threshold value is employed in the current source designs of the invention. In designs of the invention, a transistor gate voltage is applied to a TFT gate, which has been adjusted depending on the transistor threshold voltage, so as to ensure that the capacitor is charged to an accurately known charging voltage, irrespectively of the value of the transistor threshold voltage.

Figure 6:
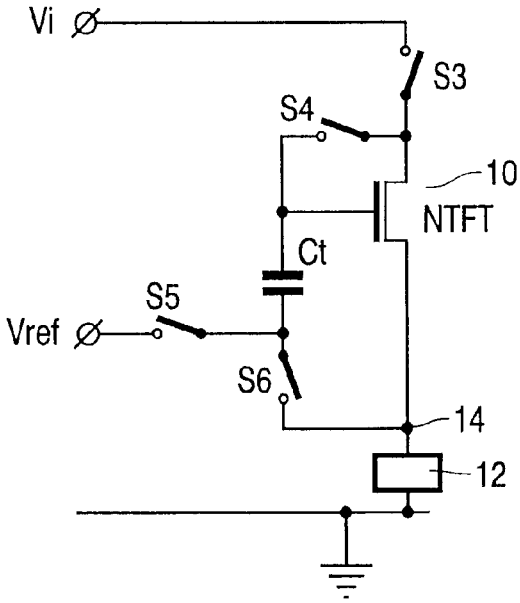
FIG. 6 shows schematically a first circuit for compensating the transistor threshold voltage for use in a display of the invention.

FIG. 6 shows conceptually a first method of compensating for the threshold voltage which can be employed in a current source of the invention.

A transistor 10 is provided for applying the charging voltage to the switched capacitor arrangement 12, in particular for providing the charging voltage on node 14. The switched capacitor arrangement 12 comprises the switches S1, S2 and the charging capacitor Ci shown in FIG. 5. The circuit draws current from the input terminal Vi which is at a fixed potential, sufficient to enable the capacitor in the switched capacitor arrangement 12 to be charged to the desired voltage through the transistor 10.

The charging voltage is applied to the circuit of FIG. 6 as a reference voltage Vref. However, this reference voltage is not applied directly to the gate of the transistor 10 (as in FIG. 5), but is instead applied through a threshold capacitor Ct. The gate of the transistor 10 is connected to one side of the threshold capacitor, and the other side of the threshold capacitor is coupled to the reference voltage input through a switch S5. That terminal of the capacitor is also connected to the node 14 through a further switch S6.

The drain and gate of the transistor 10 are selectively connected together by means of a switch S4, and a further switch S3 selectively isolates the column at the input Vi from the drain of the transistor 10. The transistor circuit operates as a voltage sampling circuit which samples the gate-source voltage for given bias conditions.

Operation of the circuit takes place in two modes. In a first mode of operation, the circuit is operated to store the threshold voltage of the transistor 10 on the threshold capacitor Ct. During this mode, the voltage Vref is isolated by opening the switch S5 and the other switches S3, S4 and S6 are all closed. The transistor is then diode-connected with its drain and gate shorted by switch S4. The voltage on the column at input Vi is larger than the transistor threshold voltage, and this voltage is applied to both the drain and the gate. The switches S1 and S2 of the switched capacitor arrangement shown in FIG. 5 are both closed so that the transistor 10 conducts between the input Vi and ground. The threshold capacitor Ct charges to the voltage on the gate in the steady state condition of the transistor. Once this has been achieved, switch S3 is opened and the threshold capacitor Ct begins to discharge, providing the drain-source current of the transistor 10, because the voltage on the threshold capacitor Ct is sufficient to turn on the transistor 10. When the gate-source voltage reaches the threshold voltage Vth, the transistor stops conducting, and the threshold capacitor is charged to a voltage equal to that threshold voltage. The switches S4 and S6 are subsequently opened so as to isolate this stored charge on the threshold capacitor.

When the reference voltage Vref is subsequently applied by closing switch S5, the gate voltage becomes (Vref+Vth). This ensures that the voltage at node 14 is equal to the reference voltage Vref, once Ci has charged, because the transistor gate voltage has been adjusted to take account of the transistor threshold voltage.

This threshold voltage compensation can be carried out each time a new reference voltage is applied. In practice, the threshold compensation will take place at the beginning of the addressing of each line of pixels in the case of a matrix array of display pixels.

The time constant of the pixel switching transistor and pixel capacitance must be large enough to allow good filtering of the current pulses which result from the switched charging and discharging of the charging capacitor Ci in the switched capacitor arrangement.

Figure 7:
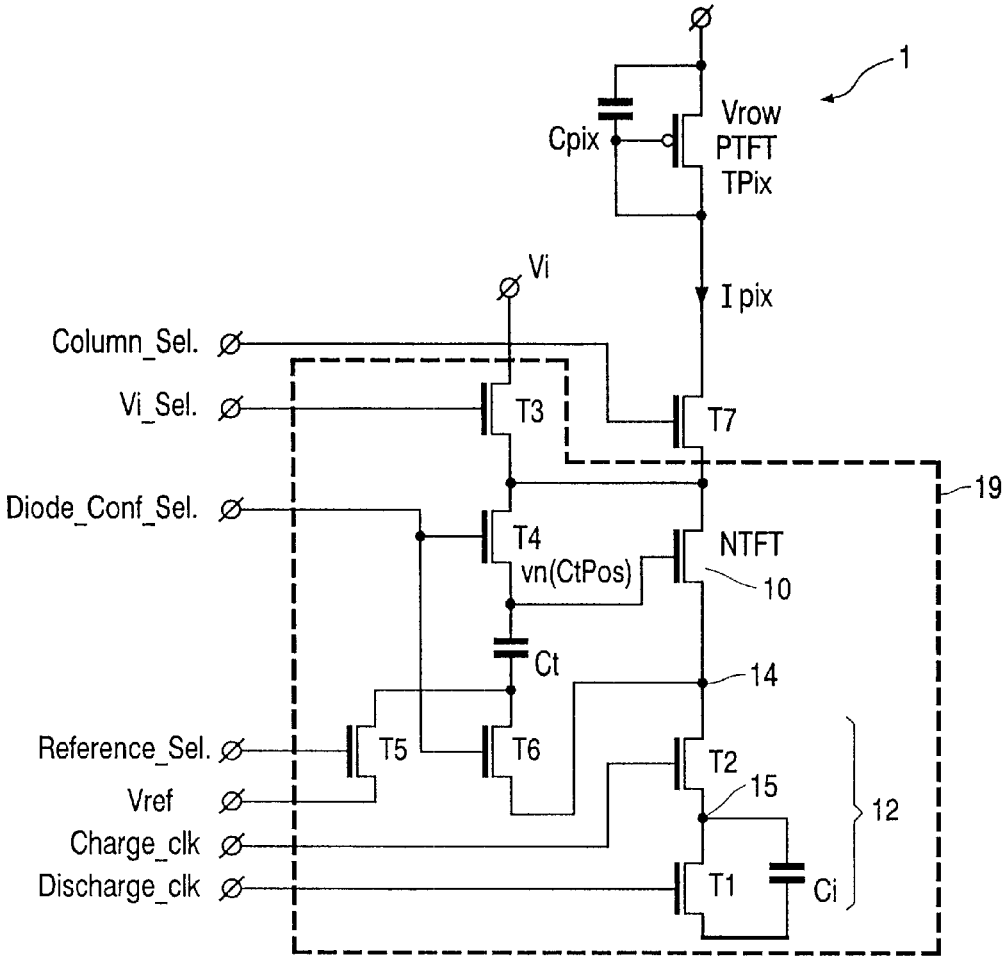
FIG. 7 shows a practical realisation of the circuit of FIG. 6.

FIG. 7 shows a practical implementation of the circuit shown in FIG. 6. The switches S1 and S2 of the switched capacitor arrangement are shown as implemented by transistors T1 and T2, and the switches S3 to S6 of the threshold compensation circuit are shown as implemented by transistors T3 to T6. The components indicated at 19 may be considered to define the current source, and an additional transistor T7 is shown connected between the current source 19 and the column of pixels. This enables the column of pixels to be isolated from the current source 19 during the threshold compensation stage. A pixel has been represented schematically at 1.

Each of the transistors T1 to T7 is associated with a control signal to be applied to the respective gate. The timing of the signals applied to the gates of the transistors determines the operation of the circuit.

Figure 8:
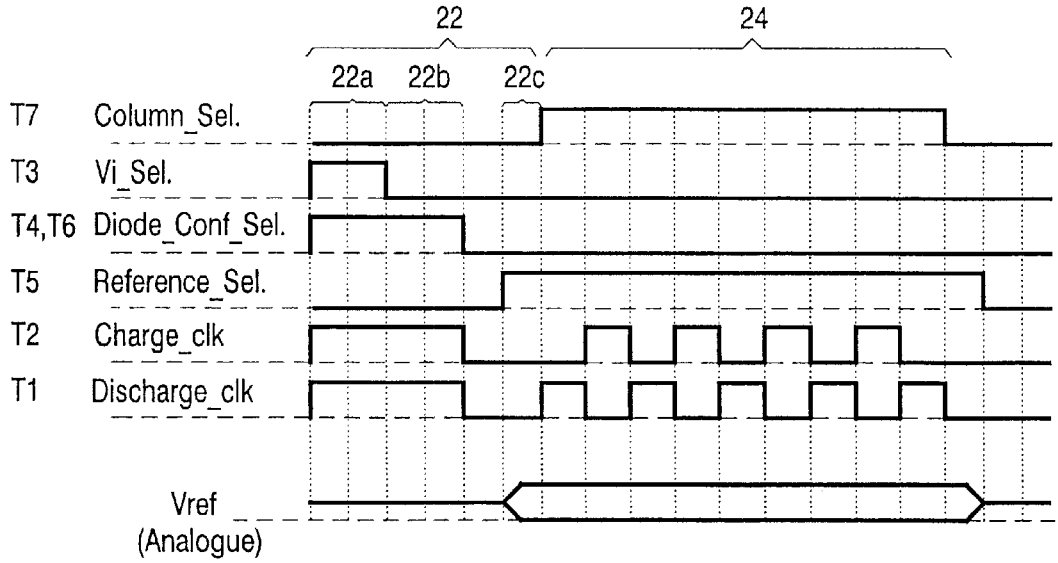
FIG. 8 is a timing diagram for the circuit of FIG. 7.

FIG. 8 shows a timing diagram for the circuit of FIG. 7. There are essentially two cycles of operation, the first cycle 22 which is the threshold compensation cycle and the current supply cycle 24.

During the threshold compensation cycle 22 the transistor T7 is turned off, and the gate voltage is accordingly low. During time period 22*a* the threshold capacitor Ct is charged to the input voltage Vi through the transistors T6, T2 and T1. After the threshold capacitor is charged the transistor T3 is turned off and the capacitor discharges through the transistor 10 during time period 22*b* until the voltage across the threshold capacitor is the transistor threshold voltage. Finally, during time period 22*c* the reference voltage Vref is applied to the threshold capacitor, to produce the desired voltage on the gate of the transistor 10. The cyclic operation of the two transistors T1 and T2 then follows during the current source mode of operation 24.

As discussed above, the circuit of the invention enables an accurately controllable voltage to be applied to the node 14. However, the charging voltage is defined at node 15, which differs from the voltage at node 14 by a transistor source-drain voltage. The transistor T2 is operated in the saturation region and the source-drain voltage is far less susceptible to variations across the substrate than the threshold voltage. This source-drain voltage can be taken into consideration when calculating the reference voltage required for a particular current output.

A potential problem associated with this design is the length of the sample period 22*b* of the threshold voltage, as the discharge of Ct is exponential. Another potential problem is the ripple voltage seen on the pixel filter capacitor Cpix. (38 in FIG. 2). The column capacitance can be as high as 20 pF and the capacitance of Cpix should be in the order of 1 pF or less. Using a charging capacitor of 0.1 pF can result in unacceptably long charging times of the column capacitor and Cpix depending on the desired performance. Increasing the size of the charging capacitor increases the, ripple voltage across Cpix. Indeed, the frequency of the charging and discharging clock can be increased, but this must be accompanied by a larger charging transistor 10 and T2. Increasing the transistor sizes has the adverse affect of introducing larger charge injection into the gate, reducing accuracy. To overcome these problems a variation of the circuit is shown in FIG. 9.

A first modification involves providing two switched capacitor arrangements. A first pair of switches S1, S2 charge and discharge a first charging capacitor Ci1, and a second pair of switches S1*a*, S2*a* charge and discharge a second charging capacitor Ci2. One capacitor is charged when the other is being discharged, and vice versa. To achieve this, the control line for one charging switch is shared with the discharging switch from the other switched capacitor arrangement, and vice versa.

An additional capacitor Cc is also provided to reduce the adverse effects of the column capacitance, and which also enables the threshold compensation to be carried out in one operation.

Figure 9:
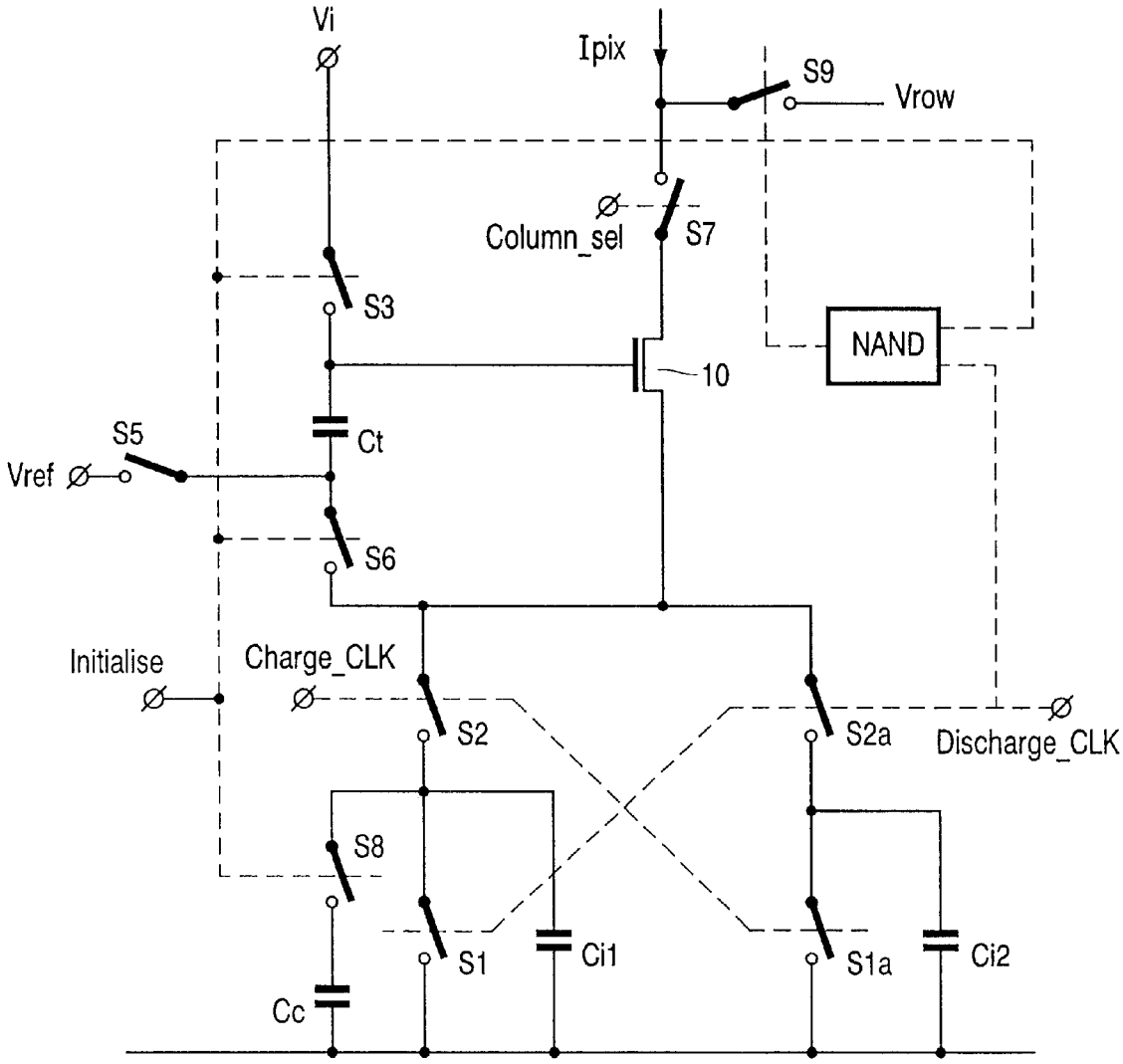
FIG. 9 shows schematically a second circuit for compensating the transistor threshold voltage for use in a display of the invention.

The control line for the switches S3 and S6 is labeled "initialize" in FIG. 9. During an initialize stage, the threshold capacitor Ct is charged to the input voltage Vi. The control signal which closes switches S3 and S6 also closes an additional switch S8 which connects the additional capacitor Cc in parallel with one of the charging capacitors Ci1. During the first charging cycle, when charging capacitor Ci1 is charged with switch S2 closed, the additional capacitor Cc is also charged. The additional charge stored on the capacitor Cc is sufficient to charge the column capacitance as well as the pixel capacitance, when the proper charging cycle begins (at the end of the initialization stage). For this purpose, the capacitor Cc is of the order of the total column capacitance of the display.

Furthermore, during the initialization stage, the column capacitors, pixel capacitors and charging capacitors Ci are also discharged. Switch S9 is provided for discharging the column capacitors and pixel capacitor, and this switch is activated only during the initialize stage and only during charging of the charging capacitor Ci1. To achieve this, the initialize signal and the discharge clock signal are supplied to a NAND gate which controls the operation of switch S9. The discharge of the column and pixel capacitors takes place through the transistor 10, and these charges are effectively passed to the additional capacitor Cc and the charging capacitor Ci1 during the initializing stage.

The initializing stage needs to be sufficiently long for the capacitors Cc and Ci1 to be charged to (Vi−Vth).

During the charging-discharging cycles following the initialization period, the voltage across the pixel capacitor becomes stabilized. The charging capacitors Ci1 and Ci2 can be smaller than in the circuit of FIG. 7, so that the frequency of the charging-discharging cycles can be increased, reducing the voltage ripple on the pixel capacitors.

Figure 10:
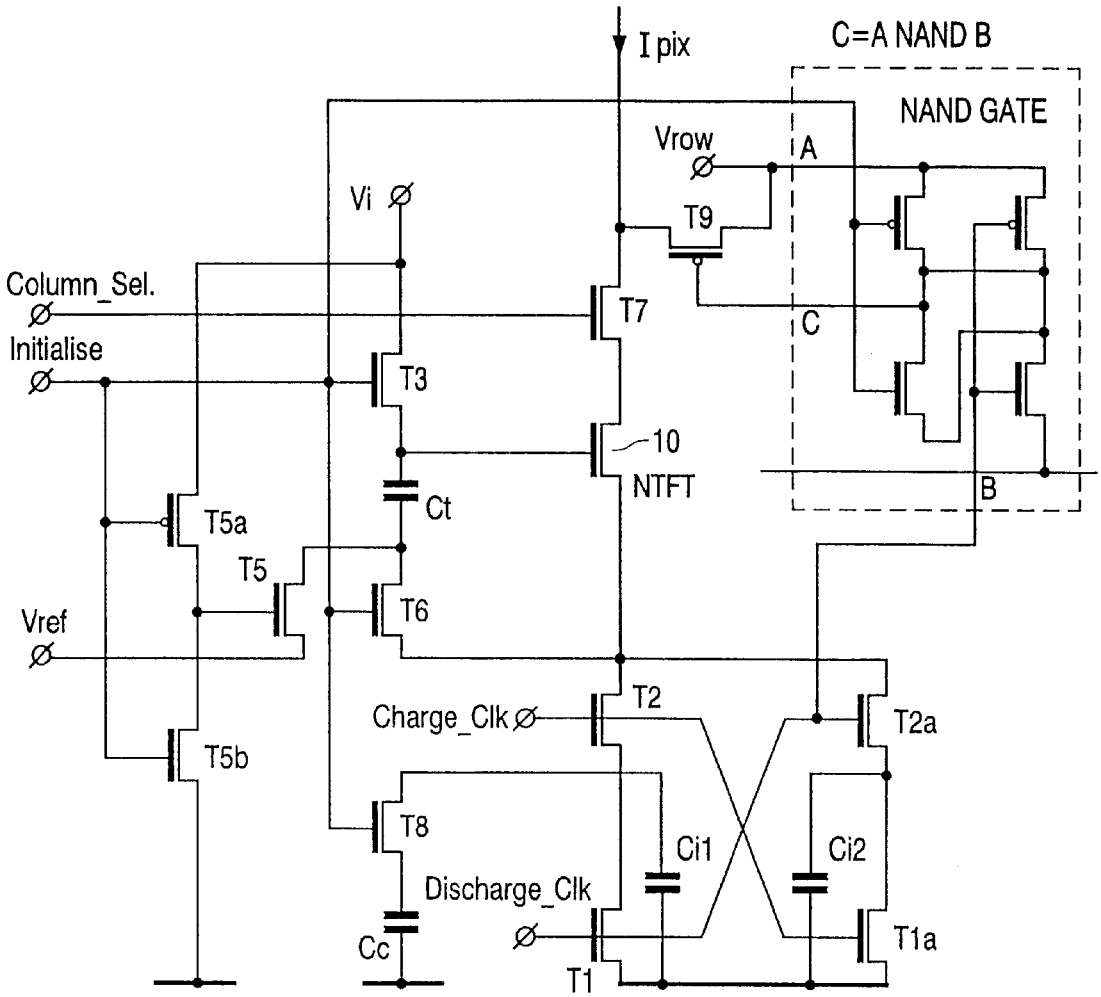
FIG. 10 shows a practical realisation of the circuit of FIG. 9.

FIG. 10 shows an implementation of the circuit of FIG. 9, in which each switch has been implemented as a transistor, and the same numerals are used. For example, switch S1 is implemented as transistor T1, and so on.

In this circuit the reference voltage can be applied as soon as the initialization stage has completed. Therefore, the control of transistor T5 is the logical inverse of the control of transistors T3, T6 and T8. To perform this inverting function, transistors T5*a* and T5*b* are provided.

Figure 11:
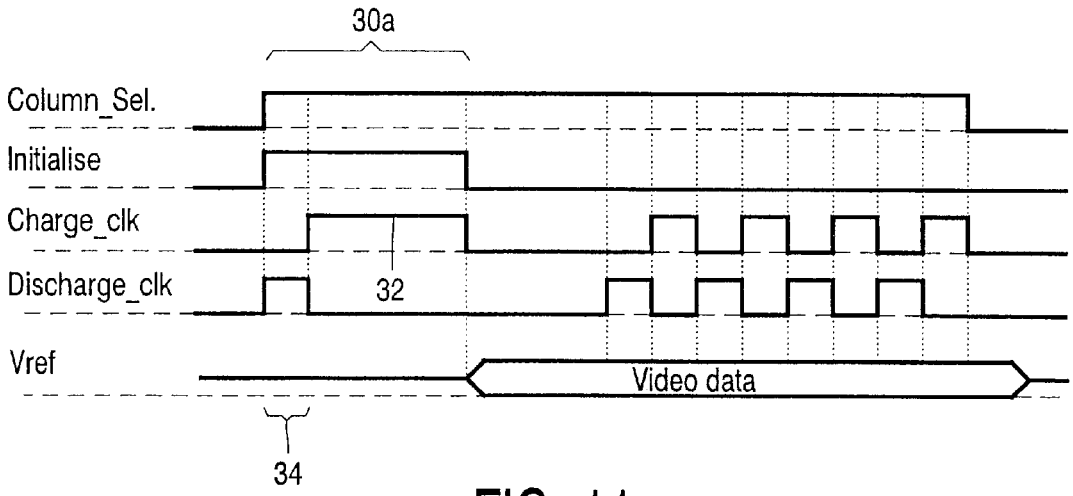
FIG. 11 is a timing diagram for the circuit of FIG. 10.

The operation of the circuit will be understood more easily from the timing diagram shown in FIG. 11.

During the initialization period 30*a*, one discharge and charge cycle is performed. The charging cycle is prolonged to allow the additional capacitor Cc to be charged, which stores the additional charge required to overcome the column capacitance of the display. The prolonged charging cycle is shown as 32. At the start of the initialization period, the output of the NAND gate is low (the two inputs being high), and this is the only time that the output is low. This unique low output causes a P-type TFT to close causing discharge of the column capacitance. After the initialization period, the output of the NAND gate is always high, turning off transistor T9 and isolating the row from the current supply circuitry. The period within the initialization time 30*a* during which the discharge clock signal is high can be considered to be a column reset period, indicated as 34.

Once the initialization period 30*a* is over, the circuit operates in the same manner as the current supply period 24 of the circuit of FIG. 7, but with the continual charging current given by the two-capacitor switched capacitor arrangement.

Figure 12:
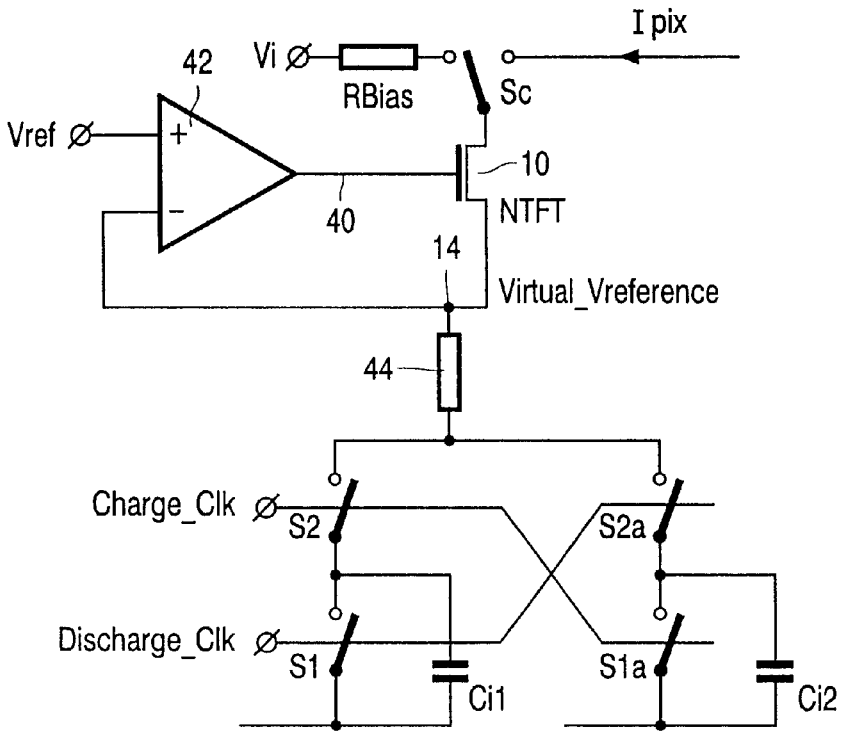
FIG. 12 shows schematically a third circuit for compensating the transistor threshold voltage for use in a display of the invention.

A further alternative approach for creating an accurately controllable voltage to which the current source capacitor or capacitors are charged is to use a differential amplifier with negative feedback. The principle is shown in FIG. 12 using an OPAMP as the differential amplifier. The output 40 of the OPAMP 42 provides the gate voltage for the transistor 10, and the source of the transistor 10 is coupled to the inverting input of the amplifier 42. The amplifier 42 provides a voltage on its output which is such as to bring the voltages on the inverting and non-inverting inputs of the amplifier to the same level. Consequently, the voltage at node 14 will equal the reference voltage Vref applied to the non-inverting terminal.

Essentially, this is a linear circuit employing negative feedback. The difference between Vref and the source voltage when the charging capacitor Ci is charged and S2 is closed will be a function of the gain of the OPAMP, and of the order of millivolts. A charging resistor 44 is used to control the initial charge flow into the capacitors. Without this resistor, the feedback loop would, in effect, become open loop when charging the capacitor. This is because the transistor 10 is unable to supply the magnitude of current required to charge the charging capacitor Ci to the target voltage Vref in an instant. The resistor 44 prevents the differential amplifier becoming saturated. Introduction of the resistor 44 does not affect the current source value, but limits the circuit frequency.

In this circuit, the double charging capacitor arrangement, as described with reference to FIG. 9, is required in order that the feedback loop is never open circuit, which would break the feedback loop and disrupt the stability of the control circuit.

The feedback loop would also be broken if the column was deselected. For this reason the addition of a Bias resistor, RBias, allows the OPAMP to continually control the transistor 10 even when the column is not selected. This bias resistor is switched out of the circuit when the column is addressed, to prevent the introduction of an offset current.

This circuit, in principle, will not have the time delay associated with sampling the threshold voltage of the transistor 10 as with the previous circuits. If the gain bandwidth of the circuit is large enough, the circuit will also be able to operate at higher frequencies. This will allow the use of a smaller charging capacitor Ci which will allow both a smaller pixel capacitance and smaller output ripple.

Figure 13:
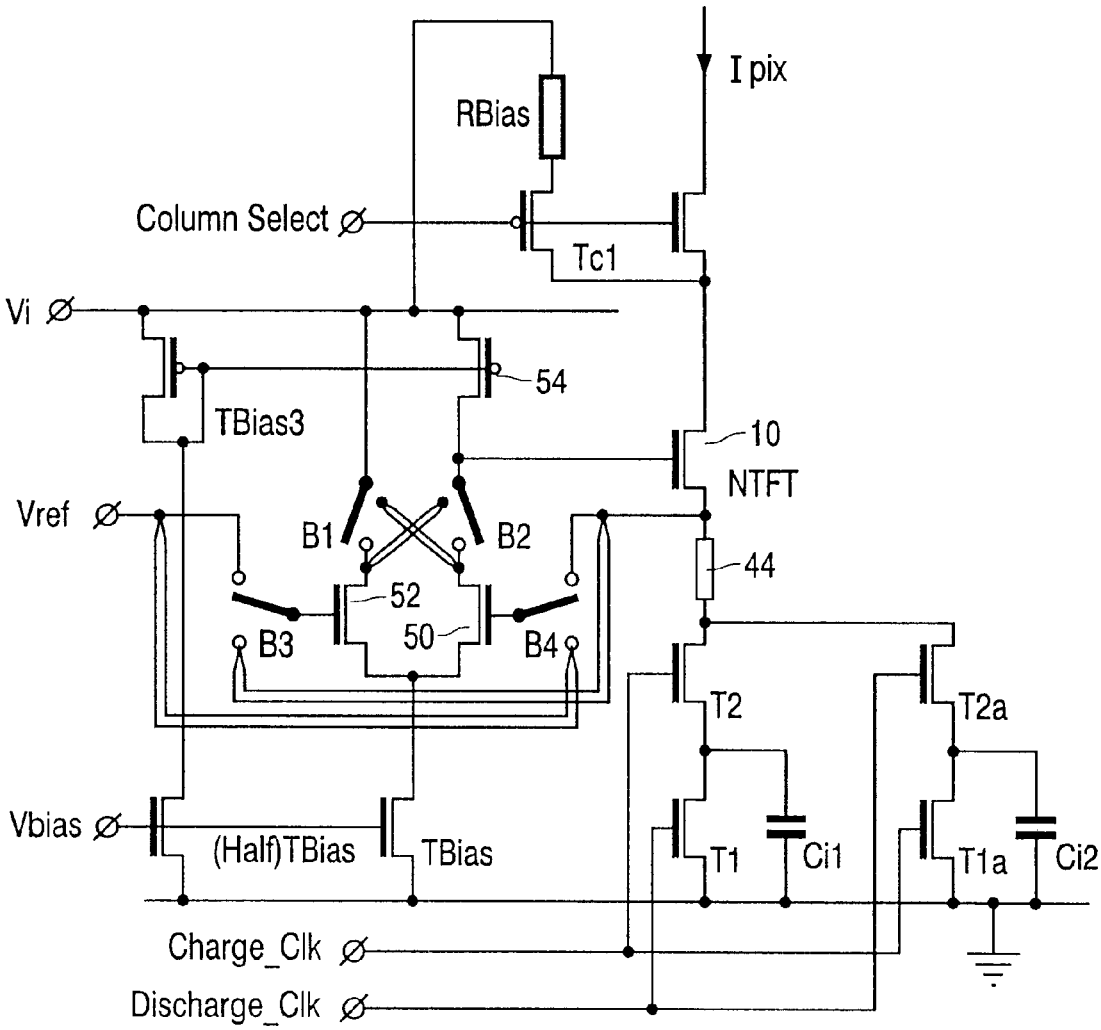
FIG. 13 shows a practical realisation of the circuit of FIG. 12.

FIG. 13 shows in greater detail an implementation of the circuit of FIG. 12.

The potential difficulty with this circuit is the input offset voltage of the differential amplifier. This is dependent on the transistor matching of transistors within the OPAMP. However, using a further eight switches it is possible to swap the positions of the transistors in the circuit. These are represented by the four bi-pole switches B1, B2, B3 and B4 and the lines marked as double lines in the Figure. The transistors making up the input stages to the OPAMP can be swapped after each charging cycle, thereby reducing the effects of mismatched transistors.

For example, when B4 connects the gate of transistor 50 to the note between the transistor 10 and charging resistor 44, B3 connects the gate of the other transistor 52 to Vref. At the same time, B2 will connect transistor 54 to the drain of the transistor 50 and B1 connects the drain of transistor 52 to Vi. All the switches then reverse and essentially the roles of transistors 50 and 52 are reversed. This removes any problems associated with transistor mismatching between transistors 50 and 52 defining the differential amplifier, as they now function as one unit and not two separate devices.

The invention may be applied to display devices having any specific pixel configuration, provided the display elements are current-addressed.

FIG. 14 illustrates an alternative, modified, form of pixel circuit which avoids the need to use opposite polarity type transistors, and which draws current from the column 14. In this circuit the transistor 33 is removed and the input terminal 36 is connected directly to the display element 20. As with other circuit there are two phases, sampling and output, in the operation of the current mirror. During the sampling phase, the switching transistors 32 and 37 are closed, through a selection pulse on the associated row conductor 12, which diode—connects the transistor 30. At the same time the supply line 31 is supplied with a positive voltage pulse, rather than remaining at a constant reference potential as before, so that the display element 20 is reverse—biased. In this state, no current can flow through the display element 20 (ignoring small reverse leakage currents) and the drain current of the transistor 30 is equal to the input current lin. In this way, the appropriate gate—source voltage of the transistor 30 is again sampled on the capacitance 38. At the end of the sampling phase, the switching transistors 32 and 37 are turned off (opened) as before and the supply line 31 is returned to its normal level, typically OV. In the subsequent, output, phase, the transistor 30 operates as before as a current source drawing current through the display element at a level determined by the voltage stored on the capacitor 38.

In the embodiment of FIG. 14, a supply line 31 connected separately to a potential source may be provided for each row of pixels. During a sampling phase the display elements in the row being addressed are turned off (as a result of pulsing the supply line 31) and if there is effectively only one common supply line in the array which is common to all pixel circuits, i.e. the supply line 31 of one row is part of a continuous line interconnecting all rows of pixel circuits, then all the display elements would be turned off during each sampling phase irrespective of which row is being addressed. This would reduce the duty cycle (the ratio of ON to OFF times) for a display element. Thus, it may be desirable for the supply line 31 associated with a row to be kept separate from the supply lines associated with other rows.

From reading the present disclosure, other modifications will be apparent to persons skilled in the art. Such modifications may involve other features which are already known in the field of matrix electroluminescent displays and component parts thereof and which may be used instead of or in addition to features already described herein.

What is claimed is:

1. A display device comprising:

an array of pixels arranged in rows and columns, each pixel comprising a current-addressed display element;

driver circuitry for generating current signals corresponding to desired outputs from the display elements, the driver circuitry comprising a transistor switching device for applying a charging voltage to a switched capacitor arrangement, which comprises a capacitor and a switch arrangement enabling the capacitor to be selectively charged and discharged at a predetermined rate to the charging voltage, wherein a transistor control voltage is applied to a control terminal of the transistor switching device so as to provide the charging voltage to the switched capacitor arrangement, and wherein the transistor control voltage is adjusted depending on the transistor threshold voltage thereby to ensure that the capacitor is charged to the charging voltage irrespectively of the value of the threshold voltage.

2. A display device as claimed in claim 1, wherein a sampling circuit is provided for adjusting the transistor control voltage, the sampling circuit comprising a switch arrangement and a threshold capacitor, the sampling circuit being operable in a first mode to charge the threshold capacitor to the transistor threshold voltage and in a second mode to add the transistor threshold voltage stored on the threshold capacitor to a transistor control voltage.

3. A display device as claimed in claim 2, wherein the threshold capacitor is connected between the gate and source of the transistor, and the switches are arranged to connect together the drain and gate of the transistor and to apply a drain and gate voltage sufficient to turn on the transistor in the first mode.

4. A display device as claimed in claim 3, wherein, in the second mode, the threshold capacitor is isolated from the source, and the transistor control voltage is applied to the capacitor, such that the transistor control voltage incremented by the threshold voltage is applied to the gate.

5. A display device as claimed in any preceding claim, wherein the switched capacitor arrangement comprises a first pair of switches and first associated capacitor, and a second pair of switches and second associated capacitor, wherein the switches are operated to provide charging of one capacitor simultaneously with discharging of the other capacitor.

6. A display device as claimed in any preceding claim, wherein the switched capacitor arrangement comprises a column capacitor which is charged during an initial operation period of the driver circuitry.

7. A display device as claimed in claim 1, wherein the adjusted transistor control voltage is provided by the output of a differential amplifier, with one of the amplifier inputs being supplied with the non-adjusted transistor control voltage and the other of the amplifier inputs being supplied to the switched capacitor arrangement as the charging voltage.

8. A display as claimed in any preceding claim, wherein each pixel comprises an electroluminescent display element.

9. A display as claimed in any preceding claim, wherein each pixel comprises first and second switching means, and being operable in a first mode in which the input current is supplied by the first switching means to the second switching means, a control level being stored for the second switching means corresponding to the input current, and in a second mode in which the stored control level is applied to the second switching means so as to drive a current corresponding to the input current through the display element.

10. A display as claimed in claim 9, wherein the second switching means comprises a TFT, and wherein the gate-source voltage of the TFT at an operating point in which the source-drain current is the input current is stored on a capacitor as the control level.

* * * * *